United States Patent [19]

Brinkman

[11] 3,972,212

[45] Aug. 3, 1976

[54] PROGRESSIVE KNURL HOLDER

[76] Inventor: Robert J. Brinkman, 389 Washington St., Spencerport, N.Y. 14559

[22] Filed: June 16, 1975

[21] Appl. No.: 587,102

[52] U.S. Cl. ..... 72/102; 72/703

[51] Int. Cl.[2] ..... B21H 7/14

[58] Field of Search ..... 72/80, 102, 703; 29/90 B

[56] References Cited

UNITED STATES PATENTS

| | | | |
|---|---|---|---|
| 1,989,651 | 1/1935 | Drummond | 29/90 |
| 2,245,654 | 6/1941 | Drader et al. | 29/90 |
| 2,378,261 | 6/1945 | Turney | 72/703 |
| 2,579,611 | 12/1951 | Poorman | 72/703 |
| 2,870,662 | 1/1959 | Poorman | 72/703 |

*Primary Examiner*—Lowell A. Larson

*Attorney, Agent, or Firm*—Shlesinger, Fitzsimmons & Shlesinger

[57] ABSTRACT

The holder comprises a first section containing in one end a slot in which a single knurling tool is mounted to rotate about a first axis. The first section is integral with and offset from a second section of the holder, which is used to mount the holder on the cross slide of a lathe, or the like, so that as the tool is advanced at right angles toward the work, it will be held for rotation in the holder about an axis inclined approximately 30° to the axis of the work, and will pass beneath and in tangential contact with the work to knurl the work surface as it passes transversely beneath it. Alternatively the holder can be mounted on a turret in an end working position for swinging movement transversely beneath the work.

8 Claims, 5 Drawing Figures

PROGRESSIVE KNURL HOLDER

This invention relates to knurling tools, and more particularly to a novel knurling tool holder suitable for use on automatic screw machines, lathes, and the like.

One of the customary ways of knurling a screw head, knob, or the like, is to employ a pair of toothed rolls which rotate about parallel axes in a rocking holder which fits into a circular seat in the tool so that it is free to adjust itself when both rolls are forced against the periphery of the rotating work. This form of tool requires the exertion of considerable transverse pressure by the rolls against the periphery of the rotating work, and the circular seat in the tool enables the holder to adjust itself so that the rolls bear on the surface of the work with equal intensity. One of the major disadvantages of this type of knurling tool, of course, is that the considerable pressure exerted on the work by the tool may tend to deform the work.

There are other known processes for knurling work, but each such process has inherent disadvantages, resulting for example, from the need to apply excessive radial pressure against the work during the knurling operation, or requiring rather expensive or complicated tool mountings or carriages to effect the desired knurling.

It is an object of this invention to provide an improved knurling tool holder, which enables a considerable reduction in the necessary forming pressure heretofore required to effect satisfactory knurling using known tool holders.

Still another object of this invention is to provide a novel knurling tool holder which utilizes a single knurling roll that is mounted to rotate about an axis inclined to the axis of rotation of the work.

A further object of this invention is to provide a novel knurling tool holder which is designed to advance the tool at right angles to the work so that the peripheral surface of the tool transverses the peripheral surface of the work tangentially.

Other objects of this invention will be apparent hereinafter from the specification and from the recital of the appended claims, particularly when read in conjunction with the accompanying drawings.

Figure 1:
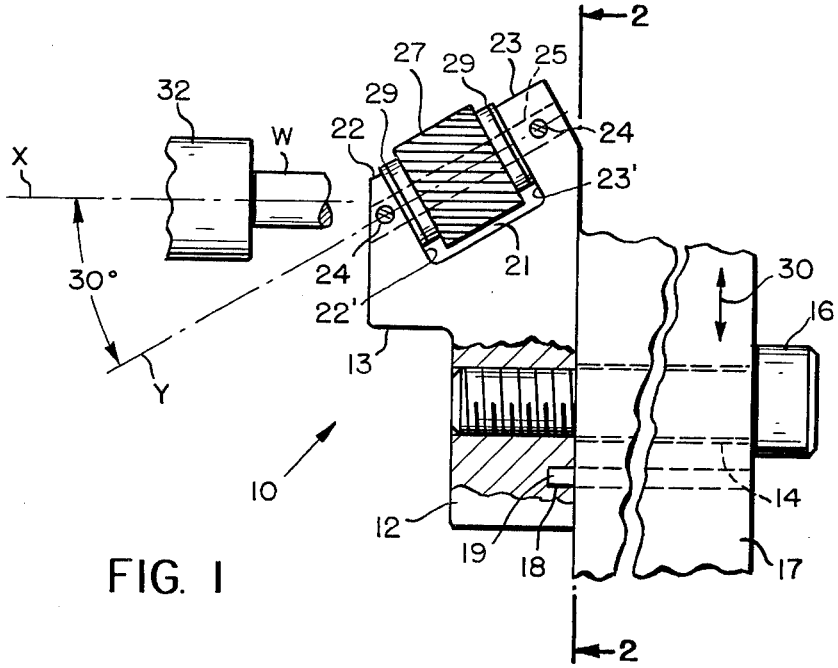
FIG. 1 is a plan view illustrating a knurling tool and holder therefor made in accordance with one embodiment of this invention, and illustrating fragmentarily a workpiece and part of the cross slide of a screw machine, or the like, upon which the holder is adapted to be mounted.

Referring now to the drawings by numerals of reference, and first to the embodiment shown in FIGS. 1 to 3, 10 denotes generally a tool holder comprising a hanger or mounting plate section 12, which is rectangular in cross section, and a tool-supporting plate section 13, which projects laterally from the side of hanger section 12. Approximately at its center section 12 has therethrough a large bore 14 for accomodating, for instance, the shank of bolt 16 which may be used to secure the holder 10 to the cross slide 17 of an automatic screw machine, lathe, or the like. In one face thereof section 12 also has a shallow, blind bore or recess 18 for accomodating a dowel 19, or the like, which may project from the cross slide into recess 18 to prevent pivotal movement of the hanger plate 12 about bolt 16.

In its outer end remote from section 12, the tool supporting section 13 has therein a large, rectangular slot or notch 21 (FIG. 1) which divides, the section into a pair of spaced arms 22 and 23 having confronting parallel surfaces 22′ and 23′, respectively, which are disposed vertically, when holder 10 is attached to slide 17, and which are inclined at approximately 30° to the face of section 12 that abuts the slide. Secured at opposite ends by screws 24 in registering openings in the outer ends of arms 22 and 23 is a cylindrical pin or shaft 25. Mounted on pin 25 for rotation coaxially thereabout in space 21 is a knurling tool or roll 27, which has spaced, parallel knurling ridges or teeth 28 formed in its outer periphery to extend at angles of approximately 30° to the tool axis. The roll 27 is held rotatably on the shaft 25 between a pair of thrust bearings 29.

Figure 2:
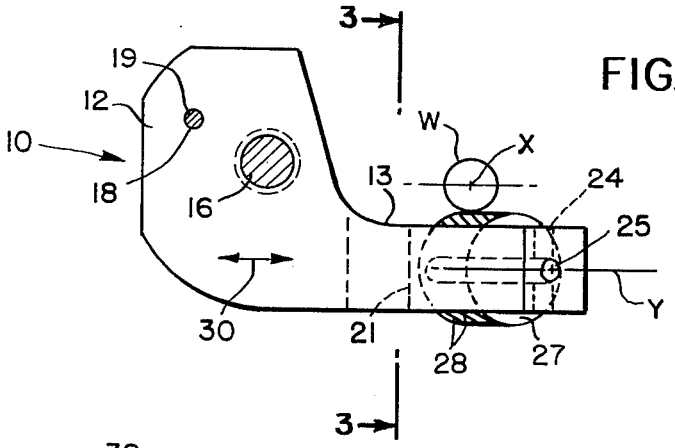
FIG. 2 is a sectional view taken along the line 2—2 in FIG. 1 looking in the direction of the arrows.
Figure 3:
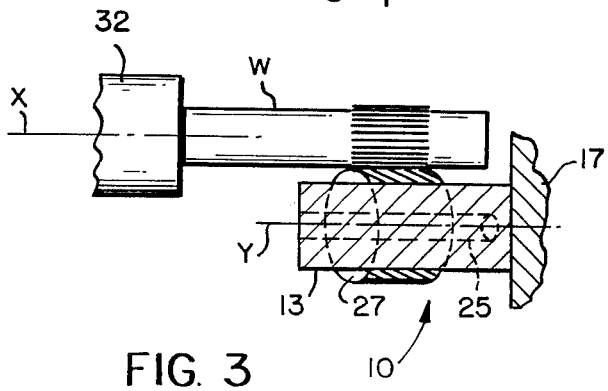
FIG. 3 is a fragmentary sectional view taken along the line 3—3 in FIG. 2 looking in the direction of the arrows.

In use the holder 10 is secured by bolt 16 to the cross slide for reciprocable movement horizontally in the direction indicated by the arrows 30 in FIGS. 1 and 2, and transversely across the end of the workpiece W, which is chucked in the usual manner in a work spindle 32 on a machine for rotation about a horizontal axis X. The knurling tool 27 is supported by the shaft 25 for rotation about an axis Y, which is normal to surfaces 22′ and 23′, and inclined at approximately 30° relative to teeth 28 and the axis X, as shown in FIG. 1. The axis Y is also disposed in a horizontal plane which is located beneath and parallel to the horizontal plane containing the axis X, as shown more clearly in FIGS. 2 and 3. In this position the knurling teeth 28 on the upper surface of the tool 27, as illustrated in FIGS. 2 and 3, project slightly above the lower surface on the work W, so that when the holder 10 is moved by the cross slide from the left to the right to its position as shown in FIG. 2, the tool 27 enters into tangential rolling engagement with the underside of the rotating workpiece W. During this travel the upper surface of the tool 27 moves horizontally so that uniform knurling pressure is exerted on the work W as the tool passes therebeneath. This knurling pressure, of course, also causes the work W to impart rotation to the tool 27 about the inclined axis Y.

It has been found that this type of knurling tool, which is advanced at right angles to the axis of rotation of the work W while being mounted for rotation about an axis inclined to the work, produces a smoother knurl on the work, as compared to prior, known knurling operations, and also requires the exertion of substantially less pressure by the tool on the work as compared to known operations. During the actual knurling operation, applicant's rotating tool 27 has only a small portion of its knurling surface in contact with the work W at any one time. As contrasted to a knurling tool which is advanced beneath the work while rotating about an axis parallel to the work, and thus always has linear contact with the work for a distance equal to the full width of the tool, applicant's tool 27 approaches almost point contact with the work since its teeth or ridges 28, in the embodiment illustrated, extend parallel to the axis X, and at an angle of, for example, approximately 30° to axis Y.

A further advantage of this construction is that the knurling surface on the tool 27 is gradually introduced tangentially against the underside of the rotating work thus avoiding any undesirable dynamic loading of the tool as it passes beneath the work. This is true regardless of whether or not the teeth or ridges 28 on the tool are inclined to the axis of rotation of the tool. For example, teeth 28 could, if desired, extend parallel to the axis Y, rather than being inclined thereto, and because of the disc-shaped configuration of the tool body 27, and because of its inclination to the axis X, the knurling surface of the tool would be gradually introduced to, and disengaged from, the underside of the work W.

Figure 4:
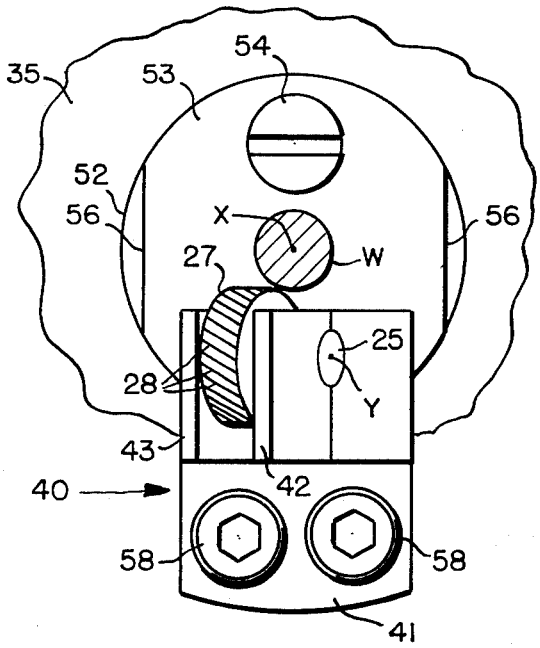
FIG. 4 is a front elevational view of a modified swing tool holder made according to a second embodiment of this invention.
Figure 5:
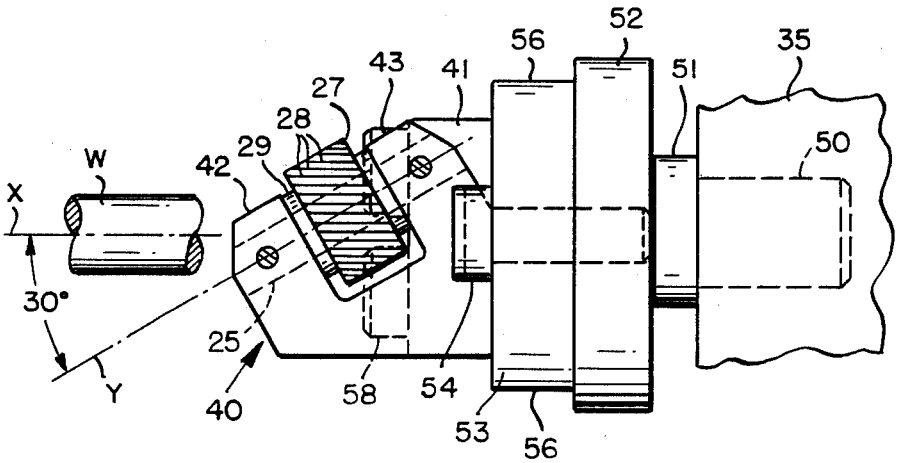
FIG. 5 is a plan view of this modified holder, the turret upon which this holder is mounted being illustrated fragmentarily.

Referring now to the embodiment shown in FIGS. 4 and 5, wherein like numerals are employed to denote elements similar to those used in the first embodiment, 40 denotes generally a swing-type of tool holder adapted to be mounted, for example, on a turret 35, or the like, to support a knurling tool in an end working position. In this embodiment 50 denotes a cylindrical stub shaft, which projects coaxially from a circular locating collar or shoulder 51, which is formed on the rear surface of a disc-shaped holder body 52 coaxially thereof. Mounted adjacent its upper end on the face of plate 52 by a pivot screw 54 is a pivot plate 53, diametrically opposite sides of which are flatted off as at 56. The lower end of plate 53 projects downwardly beneath the body 52 and has secured to its front face by a pair of cap screws 58 the knurling tool holder 40.

Holder 40 comprises a generally rectangular base section 41, which is secured by the screws 58 to plate 53. Integral with the upper end of the base section 41 and projecting diagonally forwardly therefrom are two, spaced parallel arms 42 and 43, which are similar in configuration to arms 22 and 23 in the first embodiment. As in the first embodiment a knurling tool is mounted to rotate about a pin 25 extending between the arms 42 and 43. Also as in the first embodiment, the axis of rotation Y of the tool between arms 42 and 43 is inclined approximately 30° to the axis of rotation X of the work W. In this embodiment, however, the holder 40 is adapted to be swung by pivot plate 53 about the axis of the pivot screw 54 as for example by striking the lower end of plate 53 with a cross slide on the associated machine. For this reason the radial distance from the axis of screw 54 to axis Y of the tool 27 is carefully held so that when the plate 53 is pivoted, for example clockwise in FIG. 4, the holder 40 will cause tool 27 to swing transversely beneath the work W momentarily to engage the upper surface of the tool with the underside of the rotating work. During this swinging movement of holder 40, the axis of rotation of tool 27 is held inclined at approximately 30° to axis X, so that knurling of the work takes place in much the same manner as described in connection with the first embodiment.

While in the embodiments illustrated the teeth of each knurling tool are shown inclined at approximately 30° to the tool axis, it will be apparent that this angle is selected merely by way of example, and that the tooth angle may vary, and if desired the teeth could extend parallel to the tooth axis. Moreover, while this invention has been described in connection with only certain embodiments thereof, it will be apparent to one skilled in the art, that this application is intended to cover any such modifications as may fall within the purview of this application and the scope of the appended claims.

Having thus described my invention, what I claim is:

1. In a machine of the type having a work spindle and a cross slide reciprocable transverse to the axis of said spindle, a knurling device comprising a holder, means for releasably mounting said holder on said machine for movement by said cross slide transverse to the axis of said spindle, an annular knurling wheel having a plurality of spaced knurling teeth in its outer periphery for knurling a workpiece chucked in said spindle, and means supporting said wheel on said holder for rotation about an axis inclined to and spaced from the work spindle axis, said holder being operative, during movement by said slide, to move said wheel transversely past a rotating workpiece in said spindle, while supporting the wheel for tangential, rolling engagement with said workpiece to knurl its outer surface.

2. In a machine as defined in claim 1, wherein said mounting means includes means securing said holder to said slide for reciprocation thereby, the axis of rotation of said wheel lies in a first plane spaced from and parallel to a second plane containing said spindle axis, and the point of tangency of said wheel with said workpiece remains in a third plane located between and parallel to said first and second planes during a knurling operation.

3. In a machine as defined in claim 2, wherein the axis of rotation of said wheel is inclined at approximately 30° to said spindle axis, and said first and second planes are spaced from each other a distance slightly less than the sum of the radii of said wheel and said workpiece, whereby the teeth on said wheel are pressed slightly into the peripheral surface of said workpiece during the rolling contact between said wheel and said workpiece.

4. In a machine as defined in claim 2, wherein said holder comprises a hanger section secured to said slide, and a wheel-supporting section projecting laterally of said hanger section, said supporting means comprises a pin extending across a slot in said wheel-supporting section, and coaxially through said wheel to support the wheel for rotation about said axis inclined to the spindle axis, and the periphery of said wheel projects beyond at least one side of said supporting section for rolling engagement with said workpiece.

5. In a machine as defined in claim 1, wherein said mounting means includes means mounting said holder adjacent one end thereof on said machine for pivotal movement in a plane transverse to said spindle axis, and about a pivot axis spaced from and parallel to said spindle axis, the opposite, free end of said holder registers with said cross slide for engagement and pivotal movement thereby, said supporting means comprises a pin mounted in said holder with its axis spaced from and inclined to said pivot axis and said spindle axis, and said wheel is rotatable coaxially on said pin and is supported thereby to have its peripheral surface swung tangentially and transversely past a rotating workpiece in said spindle, when said slide pivots said holder, thereby to knurl the surface of the workpiece.

6. A method of knurling, comprising mounting a single knurling tool in a holder for rotation about a first axis, moving the holder transverse to the axis of a rotating workpiece to cause the peripheral surface of the tool to travel transversely and tangentially past the workpiece, and during the travel of the tool past the workpiece, maintaining the axis of rotation of the tool at an angle inclined to the axis of rotation of the workpiece.

7. The method as defined in claim 6, including traversing the tool in a horizontal plane past the work, while holding the tool axis inclined to the work axis.

8. The method as defined in claim 6, including swinging the tool transversely past the work about an axis parallel to and spaced from the work axis, while holding the tool axis inclined to the work axis.

* * * * *